United States Patent [19]

Sanuga

[11] Patent Number: 4,566,109

[45] Date of Patent: Jan. 21, 1986

[54] DOCUMENT HANDLING EQUIPMENT WITH COUNTER CONTROLLABLE COVER

[75] Inventor: Fumiwo Sanuga, Tokyo, Japan

[73] Assignee: Billcon Co., Ltd., Kawasaki, Japan

[21] Appl. No.: 585,209

[22] Filed: Mar. 1, 1984

[30] Foreign Application Priority Data

Mar. 2, 1983 [JP] Japan ..... 58-028924

[51] Int. Cl.[4] ..... B65H 43/00; B65H 43/06

[52] U.S. Cl. ..... 377/2; 377/8; 377/16; 271/3

[58] Field of Search ..... 271/3, 4, 186, 315; 377/2, 8, 16

[56] References Cited

U.S. PATENT DOCUMENTS

| | | | |
|---|---|---|---|
| 3,084,932 | 4/1963 | Schiller et al. | 271/186 |
| 3,912,255 | 10/1975 | McInerny | 271/315 |
| 4,157,822 | 6/1979 | Miller | 271/4 |
| 4,227,074 | 10/1980 | Miyagawa | 377/39 |
| 4,275,874 | 6/1981 | Di Blasio | 271/4 |

*Primary Examiner*—John S. Heyman

*Attorney, Agent, or Firm*—Bruce L. Birchard

[57] ABSTRACT

An automatically actuated cover for the exit from a currency counter responds to activation of a counting cycle to cover the exit and responds to completion or termination of a counting cycle to open or uncover the exit.

10 Claims, 7 Drawing Figures

DOCUMENT HANDLING EQUIPMENT WITH COUNTER CONTROLLABLE COVER

BACKGROUND OF THE INVENTION

1. Field of the Invention

This invention relates to sheet-by-sheet paper counting devices and more particularly to sheet-by-sheet document and currency counters.

2. Prior Art

Automatic paper counters, for example those used for counting currency in banks, are intended to reduce the great length of time required for manual counting of the documents or currency to thus effect a savings in labor costs. Thus, it is desirable to effect counting at the maximum speed at which the counter may run. Unfortunately, other factors have to be considered, mainly the fact that if the counter runs at high speed the papers being handled have a tendency to escape from the exit region, where they are supposed to be stacked, and become flying objects which sometimes strike the operator or operators in the eyes or elsewhere on the face. Further, as the bills are counted dust is generated which, with prior art devices, discharges into the working atmosphere and pollutes it. Further, the noise level when high speed counting is being accomplished is uncomfortably high. In the past, the approach to solving these problems has been to reduce the speed of counting. Of course, this defeats the basic purpose of having an automatic counter.

Therefore, it is an object of this invention to overcome the problems of the prior art devices.

It is a further object of this invention to provide a high speed currency or paper counter which does not have its speed limited by the safety of the operator, as respects "flying" papers moving from the exit portion of the counter into the stacker portion.

SUMMARY OF THE INVENTION

A cover that has sides which are sectors of a circle and a shell which is cylindrical in shape is supported on an axis parallel to the axis of the feed rollers in the counter and such cover is driven through a half-turn clutch from the feed roller mechanism into a position in which it covers the exit from the counter during the counting process and exposes that area when the counting procedure has been completed and the feed rollers have ceased turning. Thus the noise, dust and flying objects which emanate from the prior art counters are confined to the inside of the counter and the dangers, inconveniences and noise of prior art devices are overcome.

BRIEF DESCRIPTION OF THE DRAWINGS

Features of the present invention which are believed to be novel are set forth with particularity in the appended claims. The present invention, both as to its organization and manner of operation, together with further objects and advantages thereof, may be best understood by a reference to the following description taken in connection with the accompanying drawings, in which:

DETAILED DESCRIPTION OF THE PREFERRED EMBODIMENTS

Figure 1:
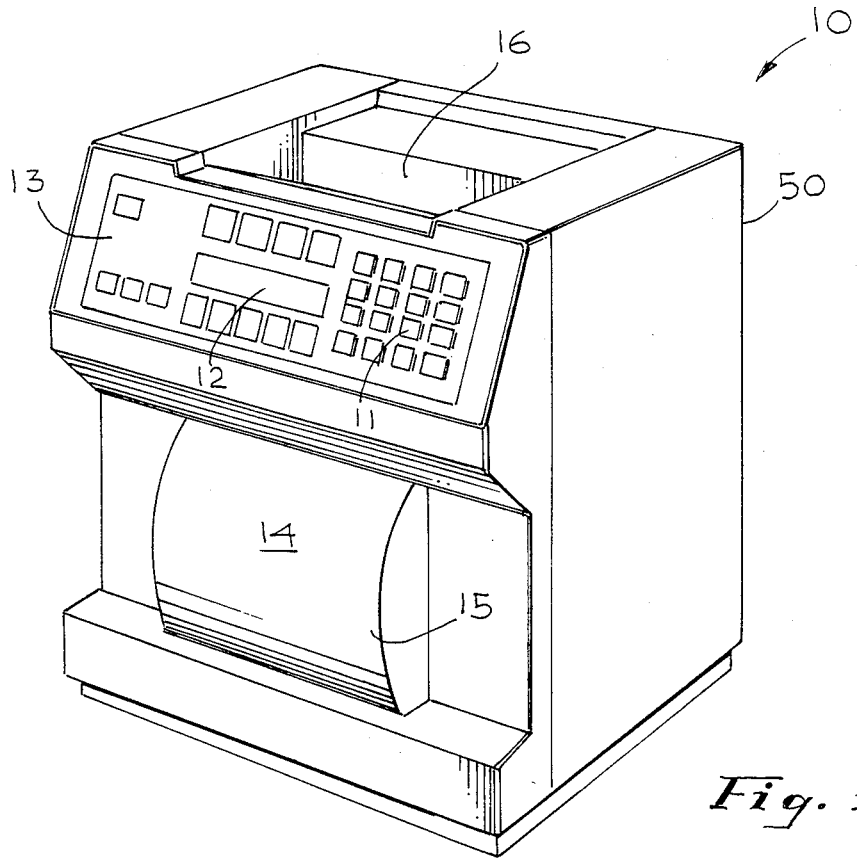
FIG. 1 is a perspective view, in elevation, of a paper counter according to this invention.

In FIG. 1, counter 10 has a casing 50 in which a panel 13 is mounted. Panel 13 has supported therein push buttons 11 and display 12 which may be an LED display. Casing 50 has an exit region 14, therein which, during operation of counter 10 is covered by cover 15, as shown in FIG. 1. Bin 16 is provided in case 50 to permit insertion into counter 10 of the documents to be counted.

Figure 2:
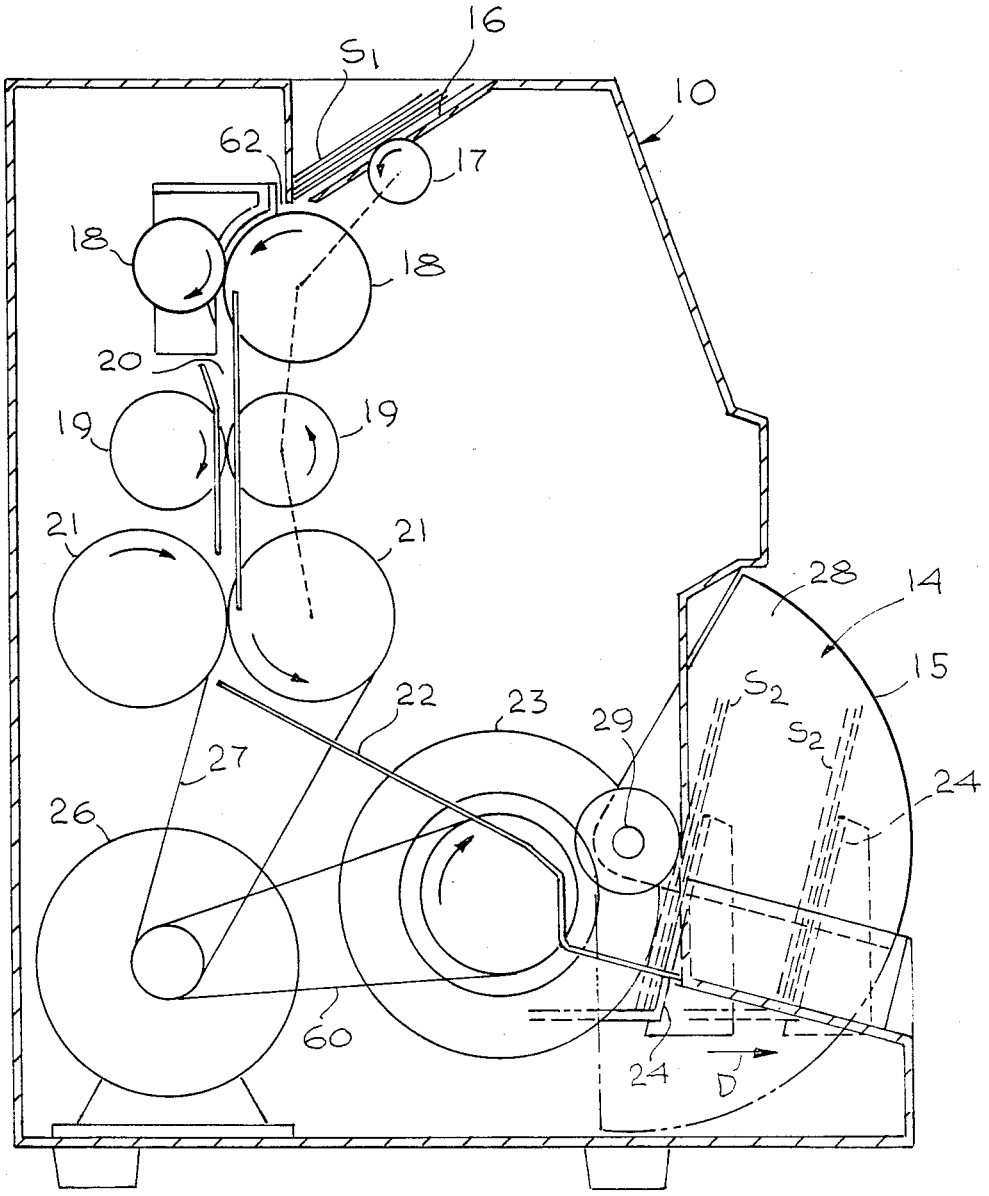
FIG. 2 is a schematic mechanical diagram showing the interrelation of various driving and driven elements in the counter of FIG. 1.

As can be seen in FIG. 2, sheets of paper to be counted $S_1$, have the bottom one of their number in contact with picker roller 17. As picker roller 17 turns (as a result of the operation of motor 26) the bottom sheet is moved through throat 62 into the region between separation rollers 18 where they are fed, one at a time, into guide 20. As the sheets $S_1$ move in guide 20 they are picked up by acceleration rollers 19 and moved out of guide number 20 into engagement by feed rollers 21. The sheets of paper are diverted by shelf 22 and are picked up by vaned roller 23 which advances them into stacker 24. As additional papers are fed into stacker 24 by vaned roller 23, stacker moves in the direction "D" away from vaned roller 23 to permit the stacking of additional sheets $S_2$ in output stacker 24.

Motor 26 through belt or chain 27 drives feed roller 21 which is inter-coupled mechanically with acceleration rollers 19, separation rollers 18 and picker roller 17. The inter-coupling between these rollers is such that all of the rollers are caused to rotate when the machine is in the counting mode. Vaned roller 23 is also driven from motor 26, and in this case through belt or chain 60.

Figure 3:
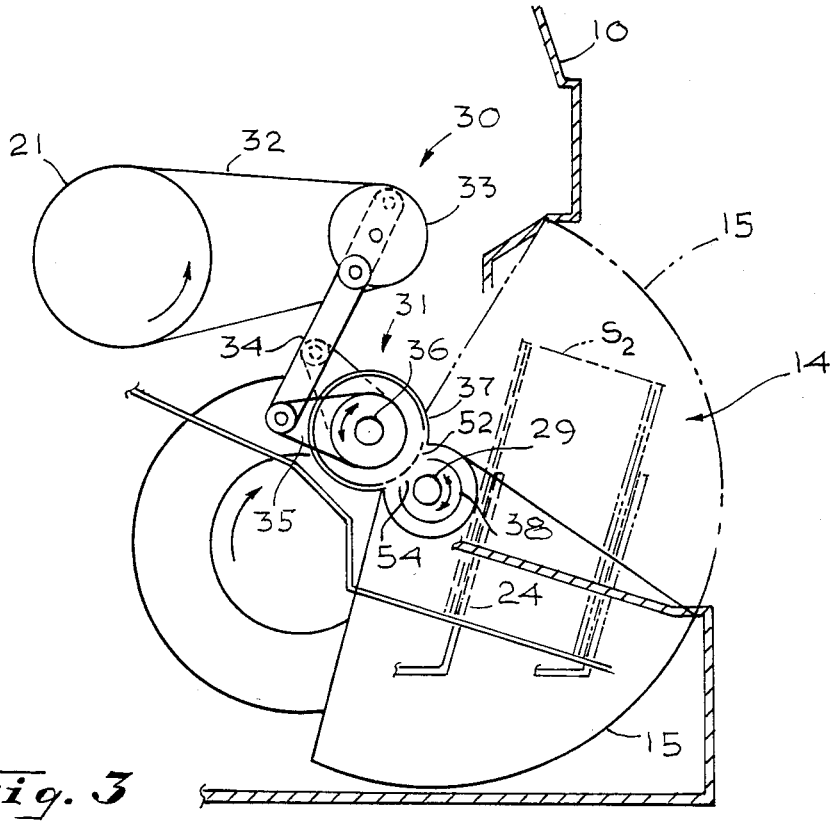
FIG. 3 is a schematic mechanical diagram of the portion of the diagram of FIG. 2 which is most pertinent to the nature and operation of this invention.

Turning to FIG. 3, the portion of the mechanism for controlling cover 15 is shown in the static or non-counting mode of counter 10. As can be seen, in the static mode, cover 15 is rotated into a position which leaves exit region 14 open for removal of papers from stacker 24. Slip clutch mechanism 30 is driven through belt or chain 32 from feed roller and the details of its operation may be seen more clearly in FIGS. 3A and 3B. Slip clutch mechanism 30 includes half-turn clutch 33 the function of which is seen more clearly in FIGS. 3A and 3B. Half-turn clutch number 33 is coupled by linkage 34 to arm 35 which rotates at its opposite end about axis 36. Toothed member 37 also rotates with axis 36 and its toothed region 52 engages, cooperatively, toothed sector 54 on drive element 38 which is fixed upon and rotates with axis 29 with which cover 15 rotates. When linkage 34 moves downwardly as a result of the rotation of half-turn clutch 33 arm 35 is rotated in a counter-clockwise direction causing toothed element 38 to rotate in a clockwise direction to produce the opened condition shown in FIG. 3. When half-turn clutch mechanism 30 and specifically element 33 rotates through another half-turn under the control of the operator who activates driver roller 21 by pressing a "count" or "reset" button 11 linkage 34 is pulled upward by the rotation of element 33 to the phantom position shown in FIG. 3 and such motion of linkage 34 causes arm 35 to rotate in a clockwise direction, which causes cover 15 to move upwardly into the phantom-line position, in which position exit region 14 is closed by cover 15. It remains closed until the counting operation is completed at which time a sensor indicating the end of a count briefly activates motor 26 causing feed roller 21 to rotate until another half-turn is executed by element 33 and cover 15 is opened to the position shown in FIG. 3.

Figure 3A:
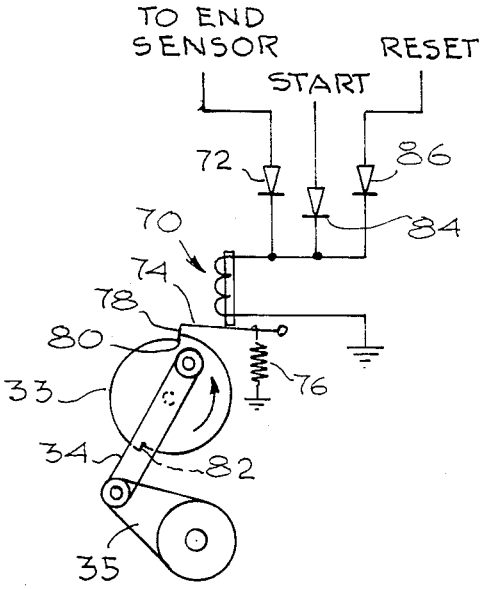
FIG. 3A is a schematic diagram of the activating portion of the mechanism of FIG. 3.

Turning to FIG. 3A for a further explanation of how the half-turn clutch element 33 operates, when the end of a count is reached, a sensor detects the lack of papers flowing past it and sends out a signal which completes the circuit from a source of operating power, not shown, through solenoid 70 by way of diode 72 which results in the energization of solenoid 70 and its operation upon latch arm 74 against the force of spring 76 to remove pawl or tip 78 of latching-arm 74 from notch 80 in half-turn clutch element 33 permitting the half-turn rotation of element 33 with the resultant downward motion of linkage 34 and the counterclockwise rotation of arm 35 which produces a clockwise rotation of toothed element 38, seen in FIG. 3, and the rotation of cover 15 to the opened position shown in FIG. 3. When element 33 is rotated 180 degrees, approximately, notch 82 engages tip 78 which is no longer held upwardly by solenoid 70, since solenoid 70 was energized only momentarily upon receiving a pulse from the end sensor, not shown, and spring 76 urges latching-arm 74 downwardly. If the start button which is one of the buttons in the group of buttons 11 is then pressed, current from a source, not shown, passes through diode 84 and energizes solenoid 70 causing tip 78 to be pulled out of notch 82, thus permitting rotation of half-turn clutch element 33 approximately 180 degrees which results in the upward motion of linkage 34, the clockwise rotation of arm 35 and the counterclockwise motion of toothed element 38 with resulting closing of the exit region 14 by cover 15. The pressing of the "reset" button in the group 11 will produce the same phenomenon as the pressing of the start button, in this case, however, current passes through uni-directional diode 86.

Figure 3B:
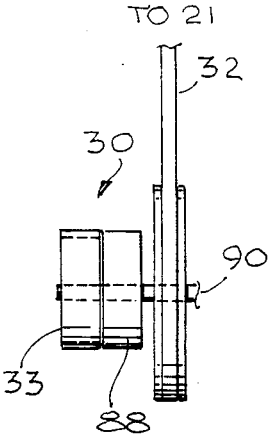
FIG. 3B is an elevation view of a portion of the mechanism of FIG. 3.

In FIG. 3B clutch element 30 includes the directly driven element 88 and the frictionally driven notched half-turn element 33. Element 33 may be held still and slips with respect to driven element 30. Element 88 is driven through shaft 90 from feed roller 21 by way of belt or chain 32.

Figure 3C:
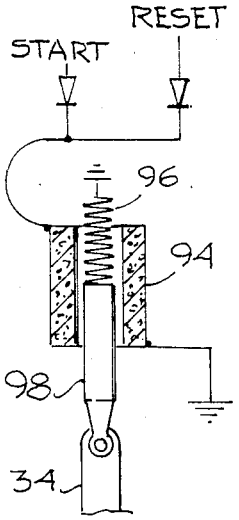
FIG. 3C is a schematic diagram of an alternative form of the cover-activating mechanism shown schematically in FIG. 3A; and, FIG. 4 is a perspective view of an alternative form of the counter of FIG. 1, according to this invention.

In FIG. 3, an alternative to the notched element 33 is shown. In FIG. 3C, solenoid 94 is energized by signals alternatively received from the end of count sensor, or the start or reset buttons, not shown in FIG. 3C . Compression spring 96 presses slug 98 downwardly. Slug 98 is connected to linkage-arm 34 which results in the opening of cover 15 exposing the exit area 14. When solenoid 94 is energized by pressing either the start or reset buttons in the center buttons 11 slug 98 is pulled upwardly causing linkage 34 to be pulled upwardly which results in the closing of cover 15 over the exit region 14 until the end of the count is reached and the current to the solenoid is terminated.

Instead of the structures of FIGS. 3A, 3B and 3C, a reversible motor may be utilized and protruberances on element may cause the alternate reversal of the direction of the motor driving cover 15, alternatively, into or out of the exit region 14.

Figure 4:
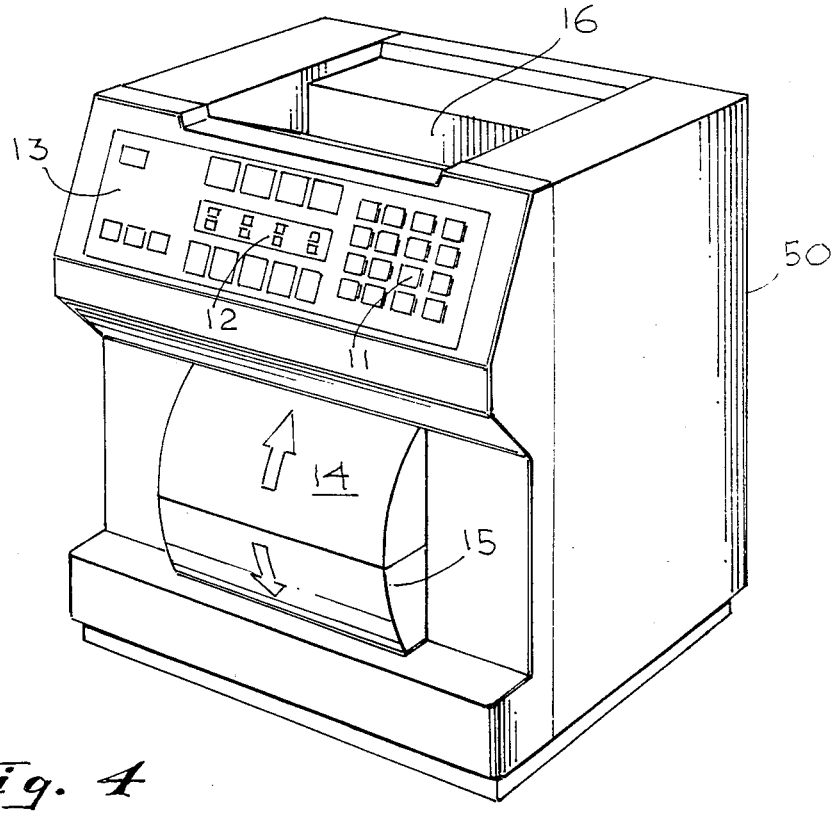

While a single piece cover 15 has been shown in FIG. 1, cover 15 may be split and caused to open from the center line as shown in FIG. 4. The mechanism for achieving such opening is substantially the same as that which has already been described.

While particular embodiments of this invention have been shown and described, it will be apparent to those skilled in the art that variations and modifications may be made therein without departing from the spirit and scope of this invention. It is the purpose of the appended claims to cover all such variations and modifications.

I claim:

1. An improved sheet-by-sheet paper feed counter, including:

counting means for counting passing sheets of paper;

a case enclosing said counting means and having an inlet and an exit for said sheets of paper to be stacked and retrieved respectively;

cover means sized and positioned to cover said exit and movable, alternatively, between positions covering said exit and, exposing said exit;

count-starting means coupled to said counting means for producing a signal controlling the commencement of the sheets feeding from said inlet;

a means for producing an end-of-count signal in response to the last sheet passing to said exit included in said counting means;

said cover means being coupled to said count-starting means and said end-of-count means and responsive to signals therefrom to cover said exit and expose said exit, respectively.

2. Apparatus according to claim 1 in which said cover means includes a half-turn clutch mechanically coupled to said counting means and to said cover means.

3. Apparatus according to claim 1 in which said cover means includes a half-turn clutch, a first rotatable toothed member coupled mechanically to said half-turn clutch and caused to rotate thereby, a second rotatable toothed member cooperatively engaging said first toothed member and rotatable thereby, and a cover coupled to said second toothed member and rotatable therewith.

4. Apparatus according to claim 2 in which said half-turn clutch includes a notched disk, and a pawl positioned to engage the notches in said disk to prevent rotation of said disk where a notch is engaged by said pawl.

5. Apparatus according to claim 4 which includes, in addition, means for dis-engaging said pawl from any notch in said disk.

6. Apparatus according to claim 5 in which said means for dis-engaging said pawl from any notch in said disk is an electromagnetic solenoid.

7. Apparatus according to claim 1 in which said cover means includes a solenoid operated plunger coupled to said counting means and said cover means.

8. Apparatus according to claim 1 in which said cover means includes a half-turn clutch mechanically driven from said counting means; a first rotatable toothed member; a linkage-arm combination coupled between said half-turn clutch and said first rotatable toothed member; a cylindrical cover carried on a first shaft and rotatable therewith; a second toothed member carried on said first shaft and rotatable therewith, said second toothed member being positioned to cooperatively engage said first rotatable toothed member for rotation thereby, whereby said cover is rotated.

9. Apparatus according to claim 8 in which said cover is a sector of a cylinder.

10. Apparatus according to claim 1 which includes a stacker positioned in said exit.

* * * * *